US005878148A

United States Patent [19]

Alexandrov

[11] Patent Number: 5,878,148

[45] Date of Patent: Mar. 2, 1999

[54] COMPRESSION DRIVER

[76] Inventor: Svetlomir Alexandrov, Hildesheimer Str. 86, 30880 Hannover-Laatzen, Germany

[21] Appl. No.: 797,836

[22] Filed: Feb. 10, 1997

[30] Foreign Application Priority Data

Feb. 29, 1996 [DE] Germany ..... 196 07 610.2
Jun. 29, 1996 [DE] Germany ..... 196 26 236.4

[51] Int. Cl.[6] ..... H04R 25/00

[52] U.S. Cl. ..... 381/339; 381/340; 381/337

[58] Field of Search ..... 381/156, 199, 381/192, 158, 159, 160, 205; 181/152

[56] References Cited

U.S. PATENT DOCUMENTS 4,496,021 1/1985 Berlant ..... 181/152
4,975,965 12/1990 Adamson ..... 381/156
4,995,113 2/1991 Robineau et al. ..... 381/156
5,537,481 7/1996 Voishvillo et al. ..... 381/192

FOREIGN PATENT DOCUMENTS 26 07 198 C2 1/1977 Germany .
44 20 960 A1 5/1994 Germany .

*Primary Examiner*—Sinh Tran
*Attorney, Agent, or Firm*—Olson & Hierl, Ltd.

[57] ABSTRACT

Compression driver with a voice coil 3 which can move in an annular air gap 2 of a magnetic system 1 and with a diaphragm driven by the voice coil 3. The diaphragm 5 and compression chamber 12 are of annular design and compression chamber 12 is connected to a central sound output channel 14 around its perimeter. Owing to its annular design the diaphragm 5 has a large effective surface area and a small mass. The feed power is therefore relatively low, resonant frequency is high and therefore the fidelity of high frequencies is improved. This is particularly the case if the diaphragm is V-shaped, preferably curved towards the acute angle enclosed by it.

9 Claims, 2 Drawing Sheets

FIG.1
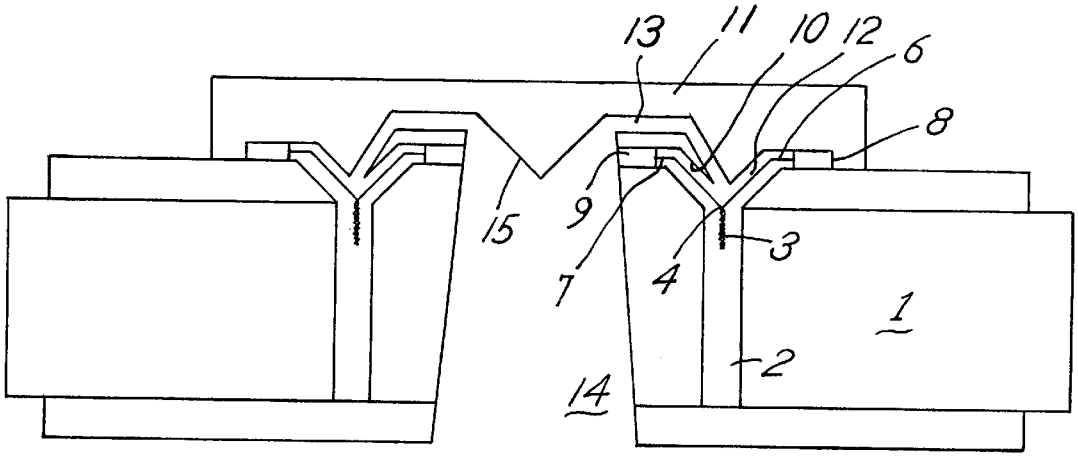
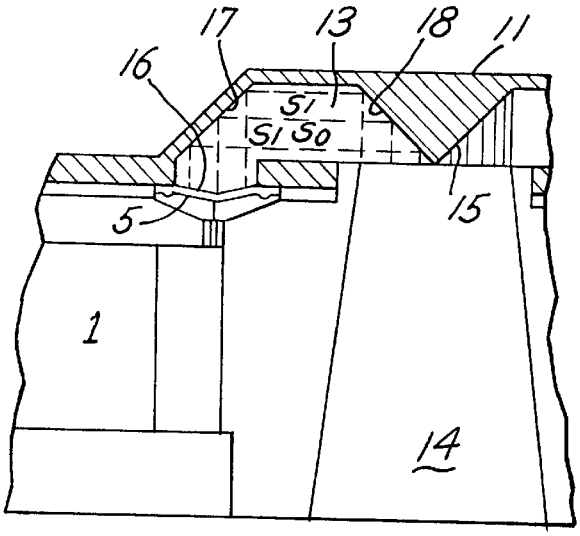
FIG.2
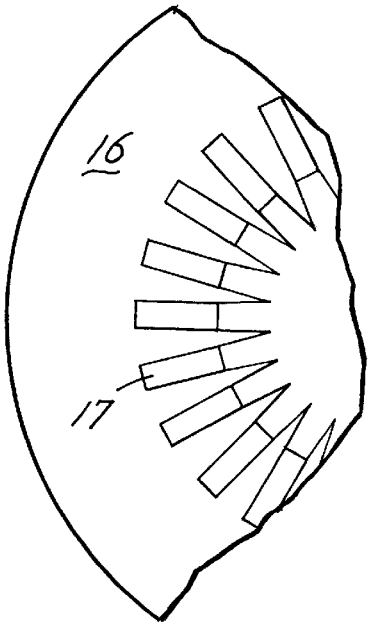
FIG.3

COMPRESSION DRIVER

BACKGROUND OF THE INVENTION

The invention relates to a compression driver having a voice coil which can move in an annular air gap of a magnetic system, a diaphragm driven by the voice coil and being part of a compression chamber, with the diaphragm and the compression chamber being of annular design.

Compression drivers of the type concerned are generally known. They particularly serve to reproduce high sounds and have a voice coil which can move in the annular air gap of a magnetic system and drives a diaphragm. With these known compression drivers the diaphragm is dome-shaped and extends between front edges of the voice coil. Opposite the inside of the dome-shaped diaphragm there is, at a distance, a surface of a solid body designed to complement the diaphragm and through which radial channels extend from various parts of the compression chamber to a central sound output channel. Since the channels indicated determine the phase position of the sound arriving in the sound output aperture on account on their length, the solid body with the channels is frequently termed a "phasing plug". Movement of the voice coil and hence also of the diaphragm, is guided by the suspension parts inside and outside the voice coil.

With such known compression drivers the dome-shaped diaphragm must have a high physical strength so that the deformations occurring due to the pressures in the compression chamber remain low. This high physical strength is frequently achieved by using relatively thick metal foils or plastics. However, this increases the mass of the diaphragm so a higher power is required to drive it, which reduces the level of efficiency. This particularly applies to higher frequencies. If, on the other hand, the diaphragm is lighter, which can only be achieved with a smaller thickness or lighter-weight material, it is normally less rigid, so in the reproduction of high frequencies in particular deformations result which cause distortions.

The invention is based on the objective of creating a compression driver of the type concerned which does not have the disadvantages described, i.e. which has a higher level of efficiency, and particularly reproduces higher frequencies better and with less distortion.

The objective upon which the invention is based is achieved by the perimeter of the compression chamber being connected to a central sound output channel.

The basic idea of this teaching is that the diaphragm is no longer positioned in the area between the front edges of the voice coil but only in the area of the front edges of the voice coils, thus giving the diaphragm an annular shape. Therefore all the parts of the diaphragm are as close to the voice coil as possible, and at the same time the active area of the diaphragm close to the coil is large relative to its mass. Owing to the relatively small mass the power required to drive the diaphragm is less. Self-resonance is increased and the reproduction, particularly of high frequencies, is improved. On account of the reduced surface area the risk of partial oscillations occurring in the diaphragm is reduced so distortion will also be reduced. Owing to the reduced mass initial and final transients are also improved.

A further development of the invention is for the diaphragm to have a V-shaped cross-section, whereby the tip of the V is connected to the voice coil. This produces a spatial stiffening of the diaphragm, thus reducing the mass of the diaphragm, also reducing the power required for driving, and improving the characteristic concerning the forming of partial oscillations of the diaphragm and fidelity, particularly at high frequencies.

A useful development of this embodiment of the diaphragm is for the sides of the diaphragm to be curved towards the acute angle enclosed by them. This further improves spatial stiffening.

It is always possible to guide and center the diaphragm by means of suspension parts. Such suspension parts, however, create the risk of partial oscillations forming. A useful development of the invention to avoid this disadvantage is for the edges of the sides of the diaphragm with a V-shaped cross-section to be suspended directly and for at least part of the diaphragm near the suspension to be made of a flexible material. The high dimensional stability of the diaphragm causes movement, of the center part of the diaphragm at any rate, in the area of the voice coil to be so effective that even higher forces can be overcome owing to the direct suspension of the edges of the diaphragm. However, these forces are reduced by the fact that the diaphragm is made of a flexible material, at least in the area of the suspension.

In the case of the diaphragm design with a V-shaped cross-section a useful development of the invention is for a wall of the compression chamber opposite the diaphragm on the side facing away from the voice coil to have a V-shape complementing that of the diaphragm. This produces a compression chamber with a very low volume so compressibility of the air inside it has a less detrimental effect.

With all the aforementioned developments of the invention it is useful to have individual channels of equal length or a rotationally symmetrical channel leading from the compression chamber out of an area opposite the voice coil to a central sound output channel. Since the annular compression chamber is the same distance from the central sound output channel at all points, the same length of individual channels can be realised in a simple manner, whereby a particularly favourable form of connection between the compression chamber and the sound output channel is for the connecting channel to have a rotationally symmetrical design. Due to the rotational symmetry there is around the perimeter a gap between the compression chamber and the sound output channel. Therefore the compression chamber is connected to the sound output channel in the same way at all points so there are no delays and therefore no detrimental effects on sound fidelity.

It is useful for the individual channels connecting the compression chamber to the sound output channel or the rotationally symmetrical channel to open out into the area of a floor of the sack-shaped sound output channel, whereby it is particularly useful for the floor of the sound output channel to be raised, and, in particular, conical. This produces a favorable phase adaptation between the channels and the sound output channel.

If, according to the invention, the voice coil has a V-shaped cross-section, whereby the voice coil acts at the tip of the V, all in all the design is symmetrical with regard to this configuration so when being driven by the voice coil lateral deflections of the diaphragm and also of the voice coil are avoided. To also provide the voice coil with maximum symmetry in relation to the combination of the voice coil and V-shaped diaphragm it is expedient to also make the voice coil symmetrical in the area of its winding. According to a development of the invention this is achieved by giving the voice coil a coil former and positioning the wire of the voice coil partially on the inside and partially on the outside of the coil former. This arrangement has the additional advantage that cooling is improved and dependence on the various amounts of thermal expansion of the materials of which the voice coil is made is reduced.

According to a very expedient development of the invention a partition is provided in a radial direction in front of the diaphragm, in which there are radial slits next to one another around the perimeter. This partition with its slits practically forms an acoustic lens, the purpose of which is to guide the sound from all the parts of the diaphragm up to the outlet of the compression driver and therefore up to the inlet of a connected horn, keeping losses to a minimum. A flat acoustic wave is formed which continues to the inlet of the horn. Also the acoustic lens improves the acoustic transformation between the diaphragm and the air and therefore ensures optimum utilization of the diaphragm. Owing to the large number of radial slits, which form admittance channels for the radiated sound, there is also a minimum of wave losses.

In the chamber or cavity in front of the acoustic lens the individual parts of the sound generated by the diaphragm are summed in phase so flat waves are formed. It is expedient for the diaphragm to have radial slits all around.

According to an expedient development of this embodiment of the invention the width d of the slits conforms to the formula $$d = \frac{\lambda}{1.7}$$

whereby $\lambda$ is the wavelength of transmitted sound. The width of the slots can also be smaller than this value. At these values a flat sound wave is propagated. With regard to such a flat sound wave it is easy to ensure in the transmission channel leading to the outlet of the compression driver that the path of any sound emerging from a slit and heading for the outlet of the compression driver is identical so that the individual components of the sound wave converge in phase and losses are only minimal.

A particularly useful development of the invention is for there to be two annular diaphragms and compression chambers opposite one another in the direction of movement of the diaphragms, whereby from the compression chambers, each from an area opposite the voice coil, there are individual channels equally distributed around the perimeter and alternately from one compression chamber and the other compression chamber, leading to a central sound output channel. Consequently, with this embodiment there are two compression chamber systems opposite one another in the direction of movement of the diaphragms and therefore in the axial direction of the system in accordance with the basic teaching of the invention and when fed appropriately they oppose one another. The sound pressure generated by them is then separated by the individual channels coming alternately from one compression chamber and from the other compression chamber and is fed to the central sound output channel. There the sound pressure is added together. This arrangement is particularly advantageous if the two opposite compression chamber systems are fed with different frequencies/frequency bands so that due account can be taken of the requirements made by the different frequencies/frequency bands.

It is expedient if the channels leading away from one compression chamber are the same length as one another and it is also expedient if all the channels leading away from the compression chambers are the same length as one another.

As already mentioned, the sound pressure in the central sound output channel is a merger of the sound pressures of the individual compression chamber systems. Since the sound waves are initially directed by the respective diaphragms in the direction of movement of the diaphragms, i.e. in the axial direction of the system, and the central sound output channel is positioned radially within it, there is bound to be, partially at any rate, a radial arrangement of the channels connecting the individual compression chambers to the central sound output channel. In this area the sound waves are rectified. For this reason it is possible that the channels leading away from the compression chambers in this area, partially at least, form a common rotationally symmetrical channel.

BRIEF DESCRIPTION OF THE DRAWINGS

The invention will be explained in greater detail using an embodiment as an example and referring to the drawing.

FIG. 1 shows an example of the invention as a cross-section to illustrate the principle FIG. 2 shows in a slightly different, enlarged representation, the left-hand part of FIG. 1, added to in accordance with a modification of the invention FIG. 3 shows a detail from FIG. 2.

FIG. 1 shows a compression driver with a magnetic system 1, in the air gap of which 2 there is a movable voice coil 3, the front edge of which is connected to one tip 4 of a V-shaped diaphragm 5, which, with its outside flexible edges 6 and 7 is firmly connected to the inside wall of an outer ring 8 and the outside wall of an inner ring 9.

Figure 5:
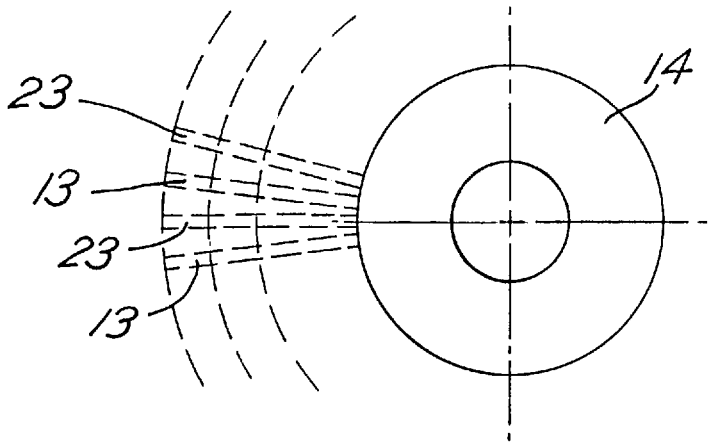
FIG. 4 shows a partial cross-section similar to FIG. 2 of an embodiment of the invention with two compression chamber systems opposite one another in the direction of movement of the diaphragms and FIG. 5 shows in a similar way to FIG. 3 from FIG. 2, details from FIG. 4.

Between diaphragm 5 and a complementarily designed wall 10 of a body 11 a compression chamber 12, which is also V-shaped, is formed, which in the area of the tip of the V has a rotationally symmetrical channel 13, which practically forms a gap covering the entire perimeter, with which sound output channel 14 is connected, the floor 15 of which is conical.

In feeding voice coil 3 the latter moves the diaphragm 5 preferably in the centre area of the annular compression chamber 12 so that the compression oscillations formed in compression chamber 12 are transmitted into the area of the conical floor 15 of the sack-shaped sound output channel 14 via the gap-shaped channel 13.

FIGS. 2 and 3 serve to illustrate a modification of the embodiment as shown in FIG. 1. FIG. 2 is an enlarged part section of the left-hand half of FIG. 1 in a slightly different representation. The same or corresponding parts are shown with the same reference numbers. The modification consists in the fact that in a radial direction in front of the diaphragm 5 there is a partition 16 which seals the space in front of the diaphragm but has radial slits. FIG. 3 shows partition 3 from FIG. 2 in a single representation, partially cut away so that the radial slits 17 are easy to see, which constitute openings for the sound emitted from diaphragm 5. Slits 17 are arranged side by side close together around the perimeter. All in all this produces an acoustic lens which ensures the formation of a flat sound wave which then continues up to sound output channel 14. The channel 13 is trapezoidal and has inclined surfaces 17 and 18. The broken lines $S_0$, $S_1$ and $S_2$ illustrate how sound components emanating from slits 17 are deflected at the inclined surfaces 17 and 18, causing them to cover the same path up to the entrance and into the sound output channel 14. For the other half of the illustrated compression chamber system the same naturally applies. At the bottom of sound output channel 14 there is therefore a flat sound wave which also then continues flatly up to the mouth of sound output channel 14. This produces an effective radiation in relation to the power applied by diaphragm 5.

Figure 4:
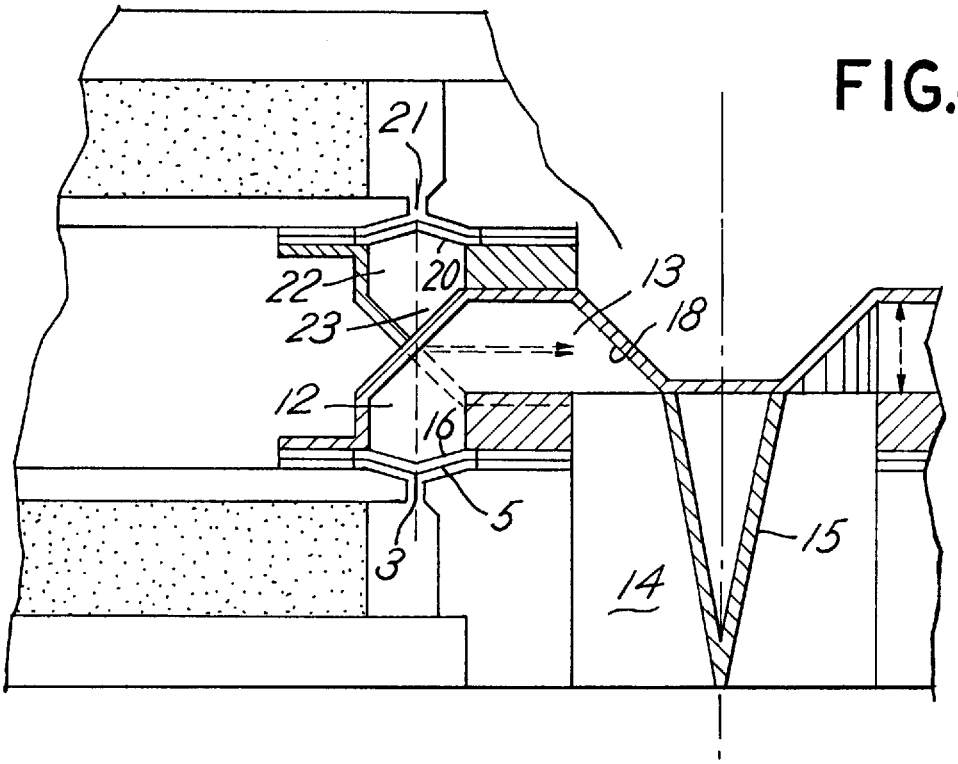

FIG. 4 shows, in a similar representation to that of FIG. 2, an example of the invention. The same or corresponding parts have been given the same reference numbers. The difference from FIG. 2 is that in the axial direction opposite diaphragm 16 there is a diaphragm 20, which is driven by a voice coil 21 and in front of which a compression chamber 22 is formed, which is connected to the central sound output channel 14 via channel 23.

As can be seen from FIG. 5, the gap-shaped channels 13 and 23 engage with one another alternately around the perimeter so that in each case the compression chambers 12 and 22 are separately connected to the central sound output channel 14. The sound waves therefore only unite when channels 13 and 23 enter sound output channel 14.

Since the gap-shaped channels 13 and 23 are partially radial before entry into the sound output channel 14, i.e. the sound in them has the same direction, channels 13 and 23 can, with a radial configuration, also be already connected to one another or pass into one another.

I claim:

1. A compression driver, with a voice coil which is movable in an annular air gap of a magnetic system and with a diaphragm driven by the voice coil and being part of a compression chamber, the diaphragm (5) and the compression chamber (12) being of annular design, the perimeter of the compression chamber (12) being connected to a central sound output channel (14), characterized in that one wall (10) of the compression chamber (12), which is opposite the diaphragm (5) on the side facing away from the voice coil (3), complements the V-shape of the diaphragm (5) and thus forms a compression chamber (12) which is also V-shaped and which in the area of the tip of the V is connected to a rotationally symmetrical channel (13) leading to the central sound output channel (14) and the rotationally symmetrical channel (13) comprises evenly distributed channels of equal length.

2. A compression driver as in claim 1, characterized in that the individual channels of the rotationally symmetrical channel (13) open out into the area of a floor (15) of the central sound output channel (14).

3. A compression driver as in claim 2 characterized in that the floor (15) of the sound output channel (14) is raised, and is conical.

4. A compression driver as in claim 2, characterized in that the central sound output channel is sack-shaped.

5. A compression driver, with a voice coil which is movable in an annular air gap of a magnetic system and with a diaphragm driven by the voice coil and being part of a compression chamber, the diaphragm (5) and the compression chamber (12) being of annular design the perimeter of the compression chamber (12) being connected to a central sound output channel (14) characterized in that in the direction of radiation there is a partition (16) in front of the diaphragm (5), and in said partition there are radial slits (17) next to one another around the perimeter, and the width of the slits (17) complies with the formula $$d = \frac{\lambda}{1.7}$$

whereby $\lambda$ is the wavelength of the sound transmitted.

6. A compression driver, with a voice coil which is movable in an annular air gap of a magnetic system and with a diaphragm driven by the voice coil and being part of a compression chamber, characterized in that the diaphragm (5) and the compression chamber (12) are of annular design and the perimeter of the compression chamber (12) is connected to a central sound output channel (14), two annular diaphragms (5, 20) and a compression chambers (12, 22) are provided opposite one another in the direction of movement of the diaphragms (5, 20) and that from the compression chambers (12, 22), each from an area opposite the voice coil (3, 21), there are individual channels (13, 23) distributed equally around the perimeter and alternately from one compression chamber (12) and from the other compression chamber (22) leading to the central sound output channel (14).

7. A compression driver as in claim 6, characterized in that the channels (13 or 23) leading away from one compression chamber (12 or 22) are the same length as each other.

8. A compression driver as in claim 6, characterized in that the channels (13, 23) leading away from both compression chambers (12, 22) are the same length.

9. A compression driver as in claim 6, characterized in that the channels (13, 23) leading away from both compression chambers (12, 22) radially form a common, rotationally symmetrical channel, at least in part.

* * * * *